United States Patent [19]

Airaksinen et al.

[11] Patent Number: 5,060,924

[45] Date of Patent: Oct. 29, 1991

[54] DEVICE FOR PICKING UP ONE PIECE OF CLOTH FROM A STACK OF CLOTH PIECES

[75] Inventors: Pentti Airaksinen, Ulvila; Jarmo Pohjolainen, Vanha-ulvila; Matti Miettinen, Pori; Seppo Varjus, Kaasmarkku; Reijo Leppäniemi, Pori, all of Finland

[73] Assignee: Cimcorp Oy, Ulvila, Finland

[21] Appl. No.: 488,036

[22] PCT Filed: Nov. 16, 1988

[86] PCT No.: PCT/FI88/00186

§ 371 Date: May 16, 1990

§ 102(e) Date: May 16, 1990

[87] PCT Pub. No.: WO89/04614

PCT Pub. Date: Jun. 1, 1989

[30] Foreign Application Priority Data

Nov. 19, 1987 [FI] Finland ..... 875116

[51] Int. Cl.[5] ..... B65H 3/20

[52] U.S. Cl. ..... 271/18; 271/18.1; 271/33; 112/121.15

[58] Field of Search ..... 112/121.15; 271/18, 271/18.1-18.3, 33, 175, 307, 308, 312, 10

[56] References Cited

U.S. PATENT DOCUMENTS

| | | | |
|---|---|---|---|
| 3,785,638 | 1/1974 | Beazley | 271/33 |
| 4,231,563 | 11/1980 | Boucraut . | |
| 4,579,329 | 4/1986 | Frost et al. | 271/33 |
| 4,657,466 | 4/1987 | Leeper et al. | 271/308 |
| 4,729,555 | 3/1988 | Brocklehurst | 271/175 |
| 4,755,096 | 7/1988 | Leeper et al. | 271/308 |
| 4,768,451 | 9/1988 | Spencer, III | 112/121.15 |
| 4,951,586 | 8/1990 | Becherini | 112/121.15 |
| 4,954,045 | 9/1990 | Gazzarrini | 271/175 |

FOREIGN PATENT DOCUMENTS

| | | |
|---|---|---|
| 102881 | 4/1898 | Fed. Rep. of Germany . |
| 3419056 | 12/1984 | Fed. Rep. of Germany . |
| 2183609 | 6/1987 | United Kingdom . |

*Primary Examiner*—Robert P. Olszewski
*Assistant Examiner*—Steve Reim
*Attorney, Agent, or Firm*—Scully, Scott, Murphy & Presser

[57] ABSTRACT

This invention relates to a device for picking up one piece of cloth (1) from a stack (2) of cloth pieces. In order that a piece of cloth could be picked up reliably irrespective of the kind of the cloth to be picked up, the device comprises a sticker member (3) for gripping the piece of cloth (1) to be picked up at the edge region thereof and for raising the edge of the piece of cloth to be picked up by turning the sticker member, an elongated support structure (8) comprising an elongated strip (4) of magnetizable metal and separating blades (6, 7) positioned on both sides of said strip, the support structure being arranged to be inserted under the piece of cloth (1) to be picked up from the side of the raised edge thereof, an elongated magnetic bar (5) positioned opposite to the magnetizable strip for locking the piece of cloth (1) to be picked up between the magnetic bar (5) and the magnetizable strip (4); and finally the separating blades (6, 7) are displaced in opposite sideward directions with respect to the magnetizable strip (4) for wholly separating the piece of cloth (1) to be picked up from the other pieces of cloth.

4 Claims, 1 Drawing Sheet

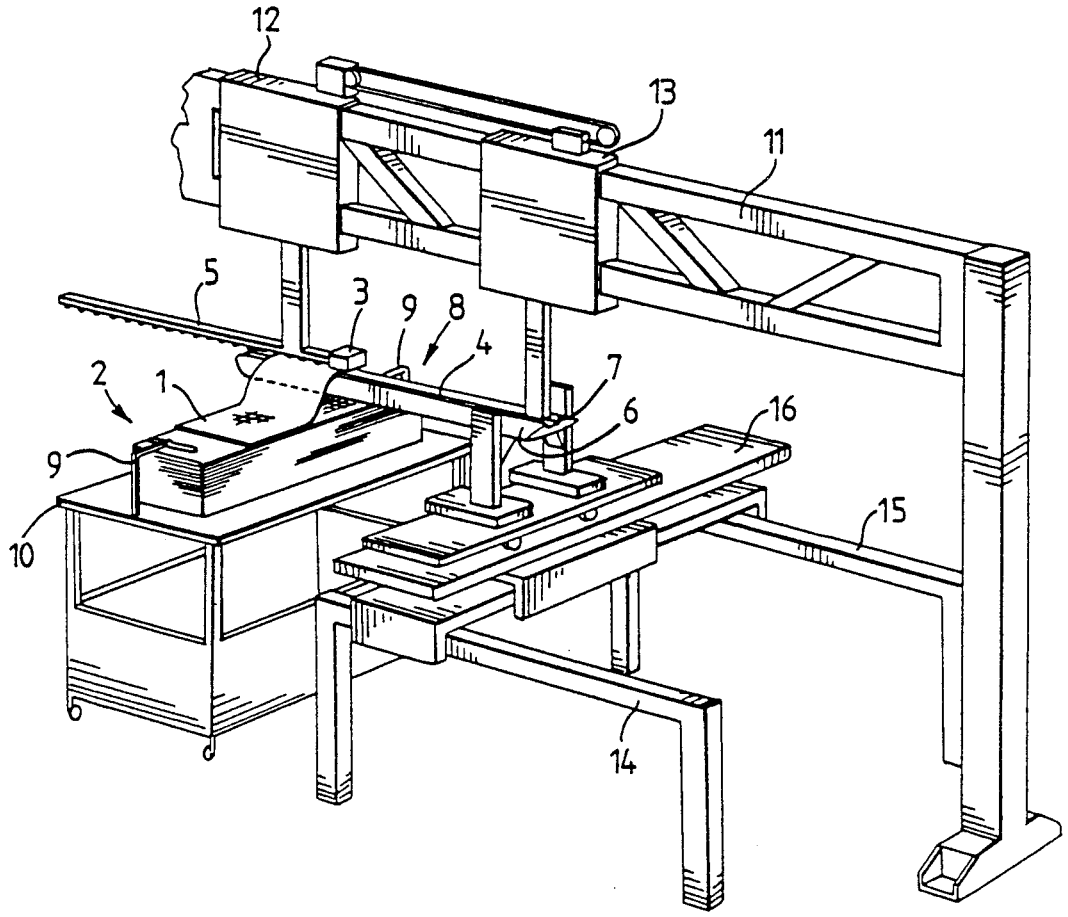
12
13
11
5
3
9
8
4
2
1
7
6
16
9
10
15
14

DEVICE FOR PICKING UP ONE PIECE OF CLOTH FROM A STACK OF CLOTH PIECES

This invention relates to a device for picking up one piece of cloth from a stack of cloth pieces, comprising means for gripping and raising the edge of a piece of cloth to be picked up; and means intended to be inserted under the piece of cloth to be picked up from the side of the raised edge thereof for separating and supporting the piece of cloth.

In clothing industry, it is customary to cut cloths used for the manufacture of garments by means of automatic cutting means which cut several cloths at a time. Such cut pieces of cloth form stacks in which there are several layers of cloth. In practice, it has proved difficult to automatically pick up one piece of cloth from such a stack and various methods and devices have been suggested for the purpose. Such devices include suction-type and sticker-type devices. In suction-type devices a major problem has been that suction applied to the stack of cloth pieces tends to take with it more than one piece of cloth. In sticker-type devices, on the other hand, the performance of the sticking means deteriorates in the long run, so that such devices are unreliable in long-term use especially when transferring pieces of cloth. An example of a more advanced technique is an arrangement in which an air jet is applied to the topmost piece of cloth in a stack from the mid area of the cloth towards its edge, so that the piece of cloth is caused to vibrate, being thus separated from the other cloth pieces. While the edge of the topmost layer "flutters", one arm of an accurately directed gripping jaw can be inserted under the piece of cloth so that the piece of cloth will be positioned between the elongated gripping jaws. Similar or closely related techniques and devices, in which particularly the structure of the means raising the edge of the piece of cloth to be picked up varies, are disclosed e.g. in German Offenlegungsschrifts 3 419 056 and 3 634 699 and U.S. Pat. No. 4 231 563. These techniques, however, are rather sensitive to the change of the kind of cloth and require in any case accurate adjustment for each kind of cloth to be operative.

The object of the present invention is to provide a device for picking up one piece of cloth from a stack of cloth pieces, which device is most reliable and is operative irrespective of the kind of the piece of cloth to be picked up.

This object is achieved by means of a device according to the invention which is characterized in that the separating and supporting means comprising an elongated strip of magnetizable metal, and separating blades positioned on both sides of said strip, the support means being arranged to be inserted under the piece of cloth to be picked up from the side of the raised edge thereof; an elongated magnetic bar positioned opposite to the magnetizable strip for locking the piece of cloth to be picked up between the magnetic bar and the magnetizable strip; and means for displacing the separating blades in opposite sideward directions with respect to the magnetizable strip for wholly separating the piece of cloth to be picked up from the other pieces of cloth in the stack. Further, it is preferable that said means for gripping and raising the edge of the piece of cloth to be picked up comprise a sticker member having a surface of an adhesive material for gripping the piece of cloth to be picked up at the edge region thereof; and means for turning the sticker member for raising the edge of the piece of cloth to be picked up apart from the stack.

In the following the device according to the invention will be described in more detail with reference to the attached drawing, in which the figure shows by way of example one specific embodiment of the device according to the invention.

The figure exemplifies a device for picking up one piece of cloth 1 from a stack 2 of cloth pieces. In the figure, the stack 2 is placed on a vertically adjustable table 10 and it is pressed by holders 9. A sticker member 3 is provided above the stack 2 so as to be pressed with a substantially constant force against the stack 2. The sticker member 3 and an elongated magnetic bar 5 attached thereto are suspended from a carriage 12 supported displaceably on a support beam 11.

A support means 8 to be inserted under the piece of cloth 1 to be picked up comprises a strip of magnetizable metal, such as a steel strip 4, and elongated separating blades 6 and 7 usually positioned on the sides of the metal strip 4 for supporting it. The metal strip 4 is suspended from a carriage 13 supported on the support beam 11 so as to be displaceable therealong, in synchronization with the carriage 12, if required. The separating blades 6 and 7, in turn, are supported by a table 16 arranged on support bars 14 and 15. The separating blades 6 and 7 are displaceable on the support table 16 substantially perpendicularly in sideward directions with respect to the metal strip 4. The support table 16 is also displaceable in the longitudinal direction of the support bars 14 and 15.

The device shown in the figure operates in the following way. Initially, the support means 8 is in its retracted position, whereby both the support table 16 and the support carriage 13 have been displaced as far backwards as is necessary for getting the support means 8 away from the area of the stack 2 of cloth pieces, in the figure to the right. At the first picking stage, the sticker member 3 is pressed with a substantially constant force against the edge region of the topmost piece of cloth 1 in the stack 2. This requires, of course, that the table 10 and the carriage 12 supporting the sticker member 3 have been properly aligned with each other in advance. After the sticker member 3 has been pressed against the edge region of the piece of cloth 1 to be picked up, the sticker member 3 is turned with suitable means (not shown) and the table 10 is lowered so that the edge of the cloth to be picked up is separated from the other cloth pieces. Thereafter, the support means 8 formed by the metal strip 4 and the separating blades 6 and 7 is displaced forwards so as to be inserted under the piece of cloth 1 to be picked up. The forward displacement of the support means 8 naturally requires that the movement of the table 16 supporting the separating blades 6 and 7 and that of the carriage 13 supporting the metal strip 4 are synchronized with each other. After the support means 8 has been inserted under the piece of cloth 1 to be picked up, a magnetizing current is connected to the elongated magnetic bar 5 forming an extension of the sticker member 3 so that the piece of cloth 1 is locked between the metal strip 4 and the magnetic bar 5, and the table 10 is again lifted up. Thereafter, the separating blades 6 and 7 are displaced in opposite sideward directions with respect to the metal strip 4 for wholly separating the piece of cloth 1 from the other cloth pieces. In this situation, the piece of cloth 1 remains between the magnetic bar 5 and the metal strip 4 attracted by said magnetic bar. In order that the piece of cloth 1 could be transferred away, the holders 9 are released so that the stack 2 is pressed by the separating blades 6 and 7 only. After the piece of cloth to be picked up has been transferred, the holders 9 are fastened in place again. At a subsequent stage, the table supporting the stack 2 of pieces of cloth is lowered down, whereby by displacing the carriages 12 and 13 simultaneously along the support beam 11 the piece of cloth 1 can be transferred without any hindrance to the following process step. The piece of cloth 1 can be removed from the picking device according to the invention e.g. by lowering the piece of cloth 1 on a suitable surface, whereafter it is gripped with suitable gripping means, the magnetic bar 5 is demagnetized and the metal strip 4 is withdrawn from under the piece of cloth. Thereafter the carriage 12 with the magnetic bar 5 and sticker member 3 thereof can be displaced to the initial position for picking up another piece of cloth.

Due the operating principle of the technique according to the invention, one and only one piece of cloth can be picked up from a stack extremely reliably. However, it is preferable to provide the sticker member 3 with a suitable sensor measuring e.g. the thickness of the cloth piece for ensuring that one piece of cloth only sticks to the sticker member. If this is not the case, attempts can be made to separate the pieces of cloth from each other e.g. by means of a suitable air jet after the edge region of the cloth pieces has been turned upwards by means of the sticker member. The surface of the sticker member 3 may be made of various adhesive materials known per se so that it sticks well to the cloth but nevertheless is easy to separate therefrom. In use, however, filaments of cloths picked up always adhere to such an adhesive surface, wherefore the surface has to be renewed every now and then. This may be carried out by heating the adhesive material so that the filaments adhering thereto sink into the adhesive material and a new surface with good sticking properties is formed. In this way the sticker member can be renewed several times before it has to be replaced with a new one. Since the function of the sticker member in the device according to the invention is not to raise the whole cloth piece to be picked up but only the edge thereof, the sticker member does not have to fulfill standards by far as high as in picking devices in which the sticker member should effect the whole lifting process.

The device according to the invention has been described above by means of one specific embodiment and it is to be understood that it can be modified in various ways without deviating from the scope of protection defined in the attached claims.

What is claimed is:

1. A device for picking up a piece of cloth (1) from a stack (2) of cloth pieces, comprising means (3) for gripping and raising the edge of the piece of cloth (1) to be picked up; and means intended to be inserted under the piece of cloth (1) to be picked up from the side of the raised edge thereof for separating and supporting the piece of cloth (1), characterized in that the separating and supporting means comprise elongated support means (8) comprising an elongated strip (4) of magnetizable metal and separating blades (6, 7) positioned on both sides of said strip, said separating blades being arranged to be substantially displaceable perpendicularly with respect to a longitudinal axis of the magnetizable strip (4), the support means being arranged to be inserted under the piece of cloth (1) to be picked up from the side of the raised edge thereof;

an elongated magnetic bar (5) positioned opposite to the magnetizable strip for locking the piece of cloth (1) to be picked up between the magnetic bar (5) and the magnetizable strip (4); and means for displacing the separating blades (6, 7) in sideward directions with respect to the magnetizable strip (4) for wholly separating the piece of cloth (1) to be picked up from the other pieces of cloth in the stack (2).

2. A device according to claim 1, characterized in that the magnetizable strip (4) is arranged to be supported by the separating blades (6, 7) prior to the magnetization of the magnetic bar (5).

3. A device according to claim 1, characterized in that said means (3) for gripping and raising the edge of the piece of cloth to be picked up comprise a sticker member having a surface of an adhesive material for gripping the piece of cloth to be picked up at the edge region thereof; and means for turning the sticker member for raising the edge of the piece of cloth (1) to be picked up apart from the stack (2).

4. A device according to claim 4, characterized in that the sticker member (3) having a surface of an adhesive material comprises means for heating the adhesive material for the renewal thereof.

* * * * *

UNITED STATES PATENT AND TRADEMARK OFFICE

CERTIFICATE OF CORRECTION

PATENT NO. : 5,060,924

DATED : October 29, 1991

INVENTOR(S) : Pentti Airaksinen, et al.

It is certified that error appears in the above-identified patent and that said Letters Patent is hereby corrected as shown below:

Column 4, line 45, Claim 4: "claim 4" should read as --claim 3--

Signed and Sealed this

Twenty-third Day of March, 1993

*Attest:*

STEPHEN G. KUNIN

*Attesting Officer*

*Acting Commissioner of Patents and Trademarks*